US008371457B2

(12) United States Patent
Entz

(10) Patent No.: US 8,371,457 B2
(45) Date of Patent: Feb. 12, 2013

(54) COLLAPSIBLE RACK FOR HOLDING EQUIPMENT

(75) Inventor: Michael L. Entz, Topeka, KS (US)

(73) Assignee: Next Inning, Inc., Topeka, KS (US)

( * ) Notice: Subject to any disclaimer, the term of this patent is extended or adjusted under 35 U.S.C. 154(b) by 390 days.

(21) Appl. No.: 12/688,436

(22) Filed: Jan. 15, 2010

(65) Prior Publication Data

US 2011/0174754 A1 Jul. 21, 2011

(51) Int. Cl.

| | |
|---|---|
| ***A47F 7/00*** | (2006.01) |
| *A47B 43/00* | (2006.01) |
| *A47B 57/00* | (2006.01) |
| *A47H 1/00* | (2006.01) |

(52) U.S. Cl. ..... 211/85.7; 211/195; 211/200; 211/104

(58) Field of Classification Search ..... 211/201, 211/85.7, 85, 85.24, 200, 202, 118, 104, 211/195, 601, 113, 117, 70.6, 175, 87.01; 248/308, 290.1, 294.1; 294/143, 146; 403/408.1, 403/353

See application file for complete search history.

(56) References Cited

U.S. PATENT DOCUMENTS

| | | | | | |
|---|---|---|---|---|---|
| 485,309 | A | * | 11/1892 | Weightman | 312/6 |
| 784,035 | A | * | 3/1905 | Connard | 211/105 |
| 995,120 | A | * | 6/1911 | Cooper | 211/41.13 |
| 1,005,820 | A | * | 10/1911 | Essex | 211/49.1 |
| 1,150,109 | A | * | 8/1915 | Flanders | 211/49.1 |
| 1,596,346 | A | * | 8/1926 | Gibson | 211/104 |
| 2,389,910 | A | * | 11/1945 | Hoffman | 211/34 |
| 2,657,810 | A | * | 11/1953 | Garrick | 108/31 |
| 3,132,745 | A | * | 5/1964 | Steiner | 211/119.1 |
| 3,698,563 | A | * | 10/1972 | Gordon et al. | 211/85.7 |
| 4,049,126 | A | * | 9/1977 | Halverson | 211/104 |
| 4,193,495 | A | * | 3/1980 | Keeley | 294/143 |
| 4,583,647 | A | * | 4/1986 | Schinzing | 211/60.1 |
| 4,595,226 | A | * | 6/1986 | Wessel | 294/146 |
| 4,629,065 | A | * | 12/1986 | Braaten | 206/315.1 |
| 5,294,005 | A | | 3/1994 | Hedges | |
| 5,337,907 | A | * | 8/1994 | McKenzie et al. | 211/88.01 |
| 5,626,244 | A | * | 5/1997 | Mesna et al. | 211/60.1 |
| 6,749,074 | B1 | * | 6/2004 | Hileman et al. | 211/85.7 |

(Continued)

OTHER PUBLICATIONS

Amazon.com, Baseball and Softball Dugout/Storage—Expando Helmet Rack at http://www.amazon.com/gp/product/images/B001VXEOKM/re . . . (dated Sep. 22, 2009).

(Continued)

*Primary Examiner* — Jonathan Liu
*Assistant Examiner* — Patrick Hawn
(74) *Attorney, Agent, or Firm* — Hovey Williams LLP

(57) ABSTRACT

A collapsible storage rack includes multiple rack members and a linkage assembly. At least one of the rack members includes a laterally extending body and a storage element that projects in a forward direction from the body. The rack members are shiftable along an upright extension direction and are shiftable relative to each other into and out of a collapsed condition. The linkage assembly shiftably interconnects the rack members and permits shifting movement of the rack members into and out of the collapsed condition.

22 Claims, 10 Drawing Sheets

U.S. PATENT DOCUMENTS

| | | | | |
|---|---|---|---|---|
| 6,948,627 | B1 | 9/2005 | Evans | |
| 7,597,205 | B2 * | 10/2009 | Shepard-Vagedes et al. | 211/200 |
| 7,789,248 | B1 * | 9/2010 | Salerno et al. | 211/85.7 |
| 2003/0062328 | A1 * | 4/2003 | Millard | 211/85.7 |
| 2006/0144806 | A1 * | 7/2006 | Joannou, Jr. | 211/85.7 |
| 2008/0277362 | A1 * | 11/2008 | White | 211/85.7 |
| 2009/0057250 | A1 * | 3/2009 | Turner et al. | 211/85.3 |
| 2009/0188819 | A1 * | 7/2009 | Carney et al. | 206/315.1 |
| 2009/0283486 | A1 * | 11/2009 | Reason-Kerkhoff | 211/85.7 |

OTHER PUBLICATIONS eSportsonline, Large Image at http://www.esportsonline.com/ITS/static/largeImage.asp?itemC . . . (dated Sep. 22, 2009).

Dugout Caddy™ Bat Rack—Sample Bat Rack at http://batracks.com/sample.php?wwin=0 (dated Sep. 22, 2009).

TheBenchCoach, Hanging Helmet Bag, Dugout Organizers, Baseball at http://thebenchcoach.com/features.php (dated Sep. 22, 2009).

* cited by examiner

COLLAPSIBLE RACK FOR HOLDING EQUIPMENT

BACKGROUND

1. Field

The present invention relates generally to storing of equipment. More specifically, embodiments of the present invention concern a collapsible storage rack to hold equipment, such as sporting goods.

2. Discussion of Prior Art

Organizers used to store sporting equipment are known in the art. For example, organizers are used to store equipment for baseball or softball games, such as softball bats and caps. Conventional baseball equipment organizers are often portable, and some transportable organizers are configured to be disassembled into a portable configuration. Other organizers are configured to be adjustably sized.

Prior art organizers are deficient and exhibit various limitations. For example, transportable prior art organizers that are adjustably sized or require assembly are awkward to shift between the portable configuration and a configuration for use. In addition, prior art transportable organizers present numerous locations where the organizer can pinch or snag adjacent objects, particularly when the organizer is being transported.

SUMMARY

The following brief summary is provided to indicate the nature of the subject matter disclosed herein. While certain aspects of the present invention are described below, the summary is not intended to limit the scope of the present invention.

Embodiments of the present invention provide a collapsible rack that does not suffer from the problems and limitations of the prior art organizers set forth above.

A first aspect of the present invention concerns a collapsible storage rack that broadly includes first and second rack members and a linkage assembly. The first rack member includes a body that presents opposite ends and extends along a lateral direction between the ends. At least one of the rack members includes a storage element that projects in a forward direction perpendicular to the lateral direction and is operable to support a stored item in front of the rack. The rack members are shiftable along an upright extension direction perpendicular to the other directions. The rack members are shiftable relative to each other into and out of a collapsed condition. The linkage assembly shiftably interconnects the rack members and permits shifting movement of the rack members into and out of the collapsed condition. The linkage assembly includes oppositely spaced first and second foldable arms each pivotally attached to the first rack member about a fore-and-aft axis adjacent to corresponding ends and pivotal into and out of a folded position corresponding with the collapsed condition. The foldable arms are attached between the rack members along the forward direction, with the arms folding in front of the first rack member and folding behind the second rack member in the folded position.

A second aspect of the present invention concerns a collapsible storage rack including first and second nestable rack members and a linkage assembly. The first and second nestable rack members include respective first and second bodies that each present opposite ends and extend along a lateral direction between the ends. The bodies each include a laterally extending central flange that presents upper and lower side margins. The rack members each include a storage element attached relative to the central flange and operable to support a stored item in front of the rack. The storage elements each project from the respective upper side margins in a forward direction perpendicular to the lateral direction to present a forwardmost margin. The rack members are shiftable relative to each other into and out of a nested condition. The linkage assembly shiftably interconnects the central flanges and permits shifting movement of the rack members into and out of the nested condition. The central flanges include corresponding channels that present an open face extending between the lower margin and the forwardmost margin. The second rack member projects through the open face of the first rack member and is at least partly received by the corresponding channel in the nested condition.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
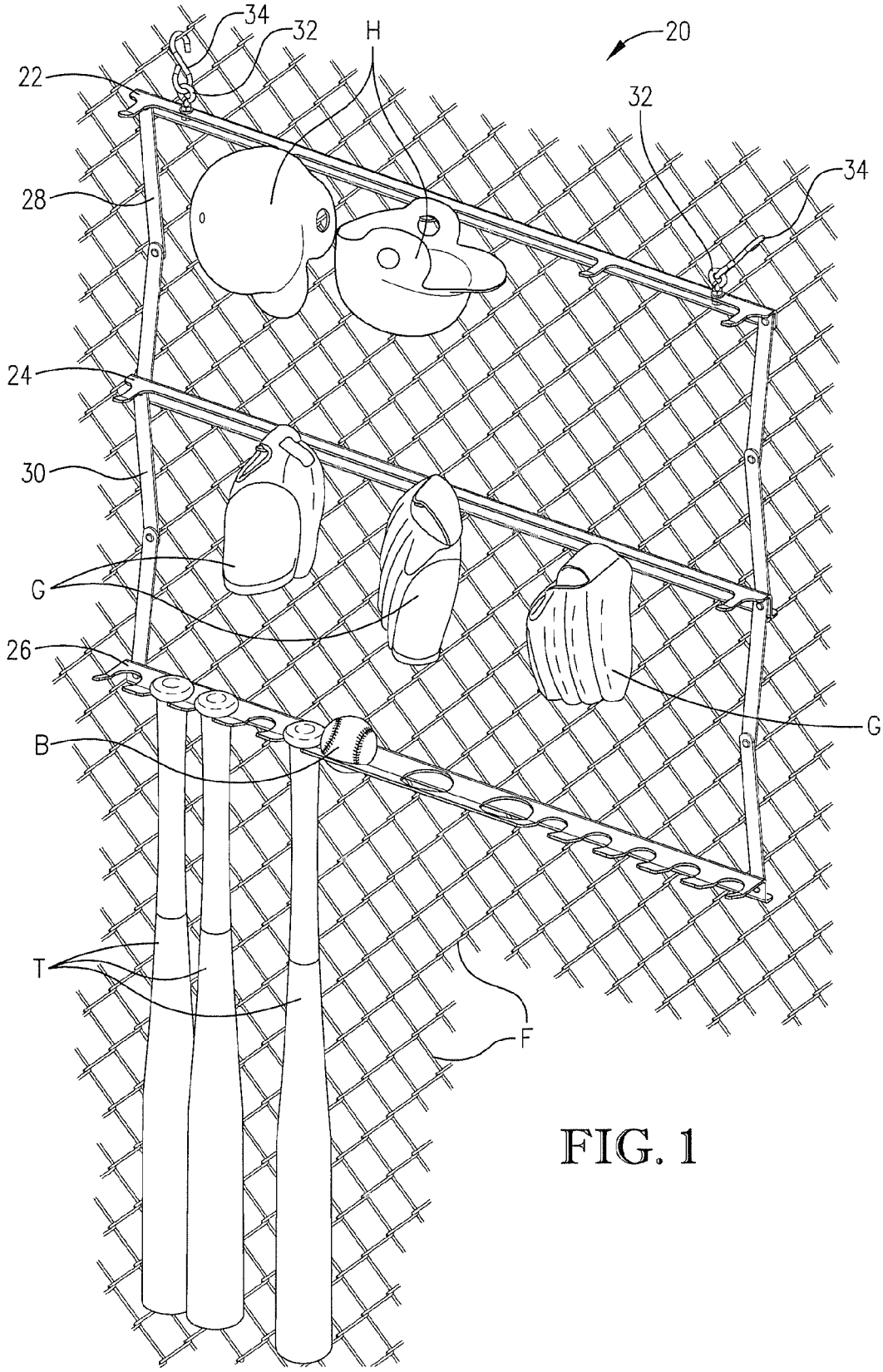
FIG. 1 is a front perspective of a collapsible rack constructed in accordance with a first embodiment of the present invention, with the illustrated collapsible rack being removably supported on a chain link fence in an extended condition by S-hooks and holding various items of sports equipment.
Figure 2:
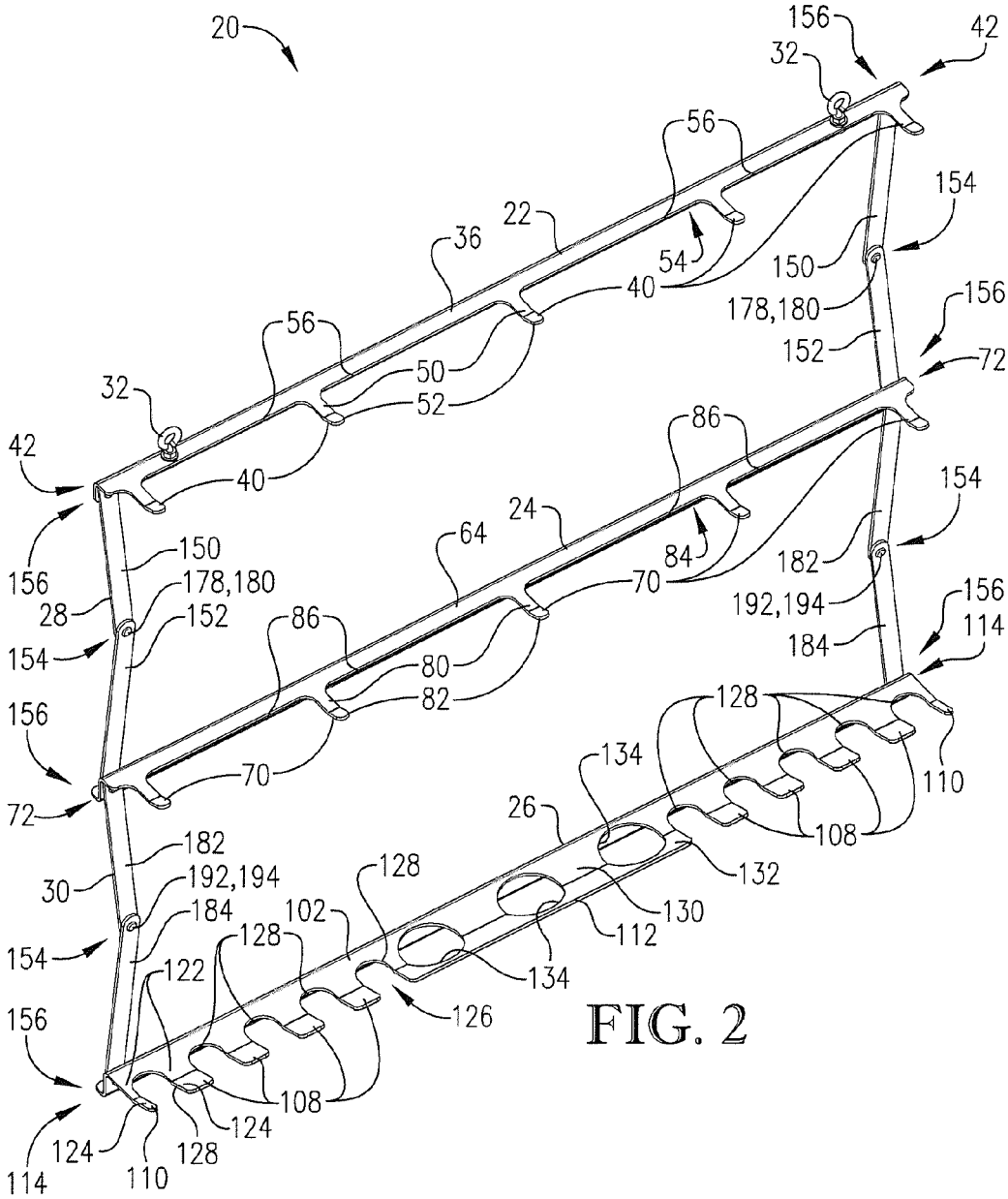
FIG. 2 is a front perspective of the collapsible rack shown in FIG. 1, showing the collapsible rack in the extended condition and including upper, intermediate, and lower rack members interconnected by corresponding upper and lower linkage assemblies and fasteners, and showing the foldable arms of the linkage assemblies in an unfolded position and interconnected by fasteners.
Figure 3:
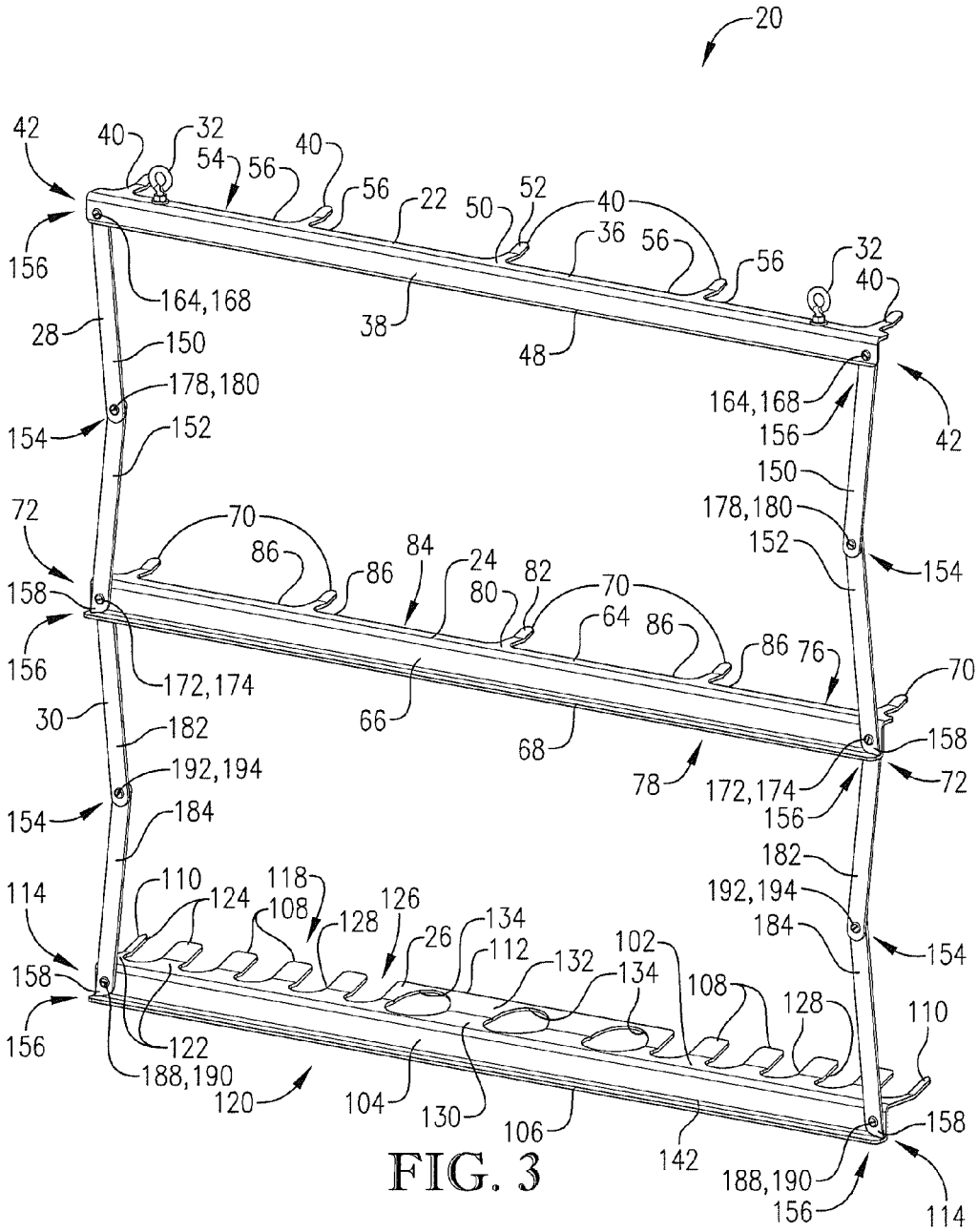
FIG. 3 is a rear perspective of the collapsible rack shown in FIGS. 1 and 2, with the collapsible rack in the extended condition.
Figures 4A, 4B:
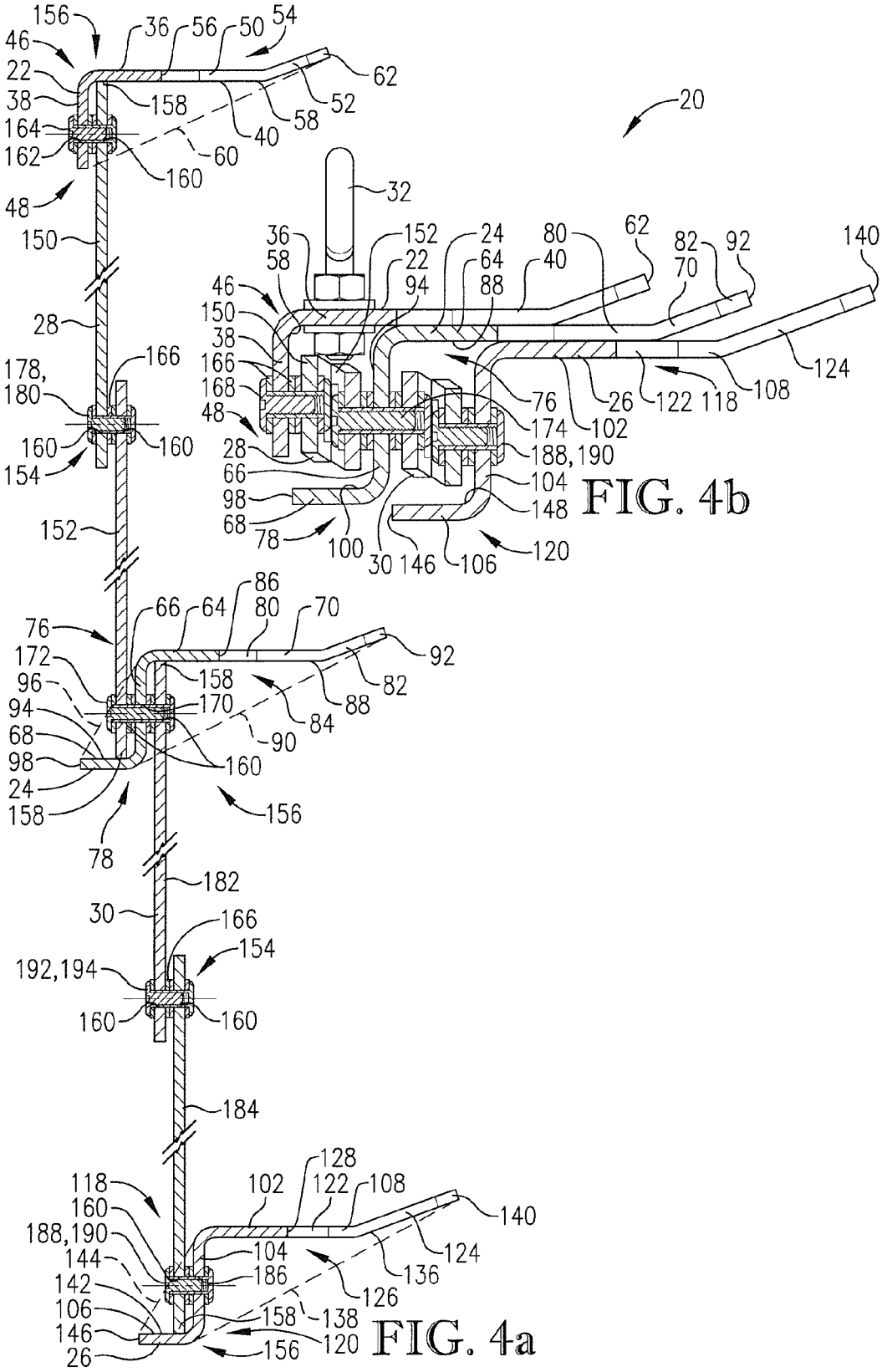
Figure 5:
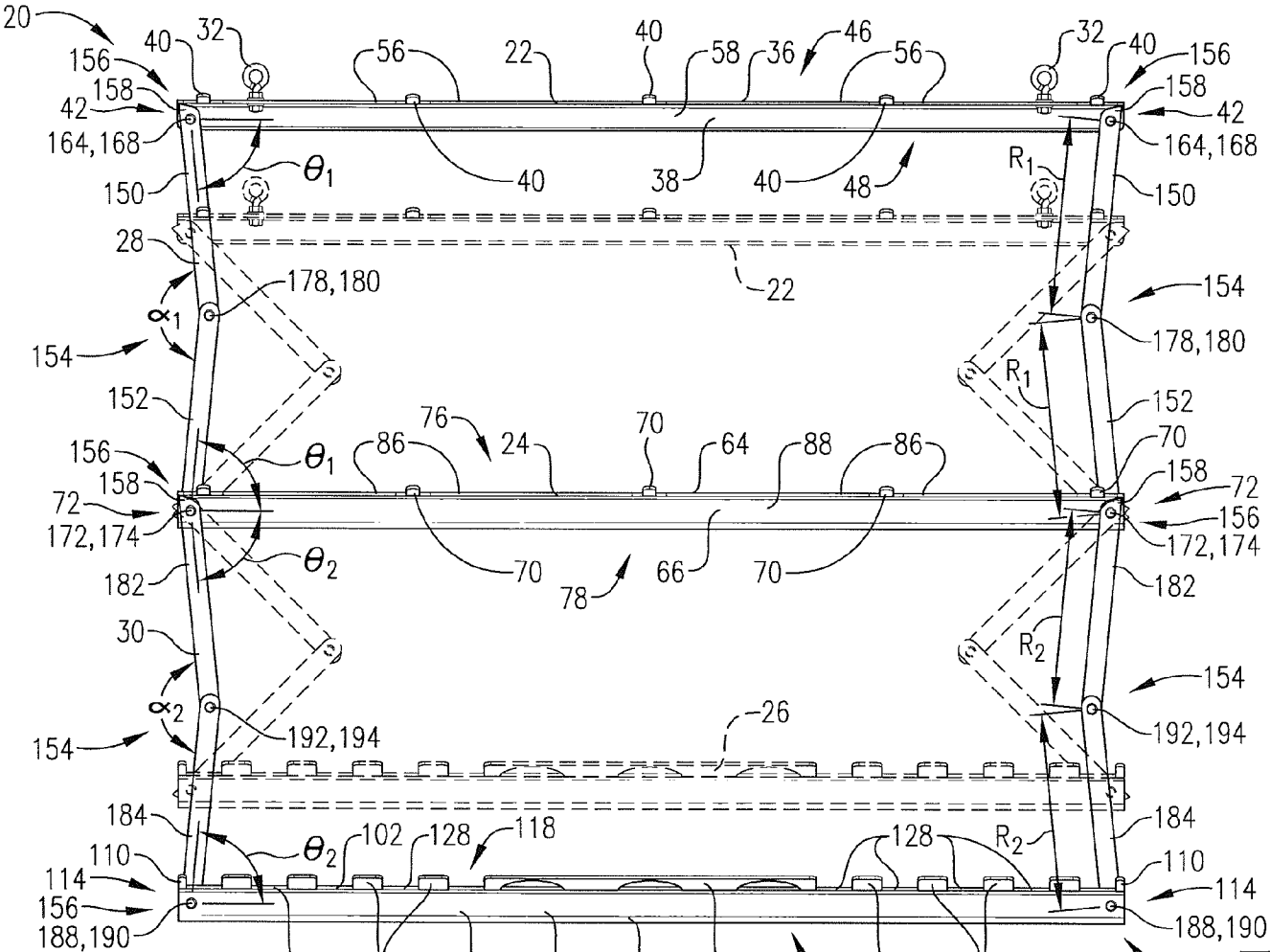
Figure 6:
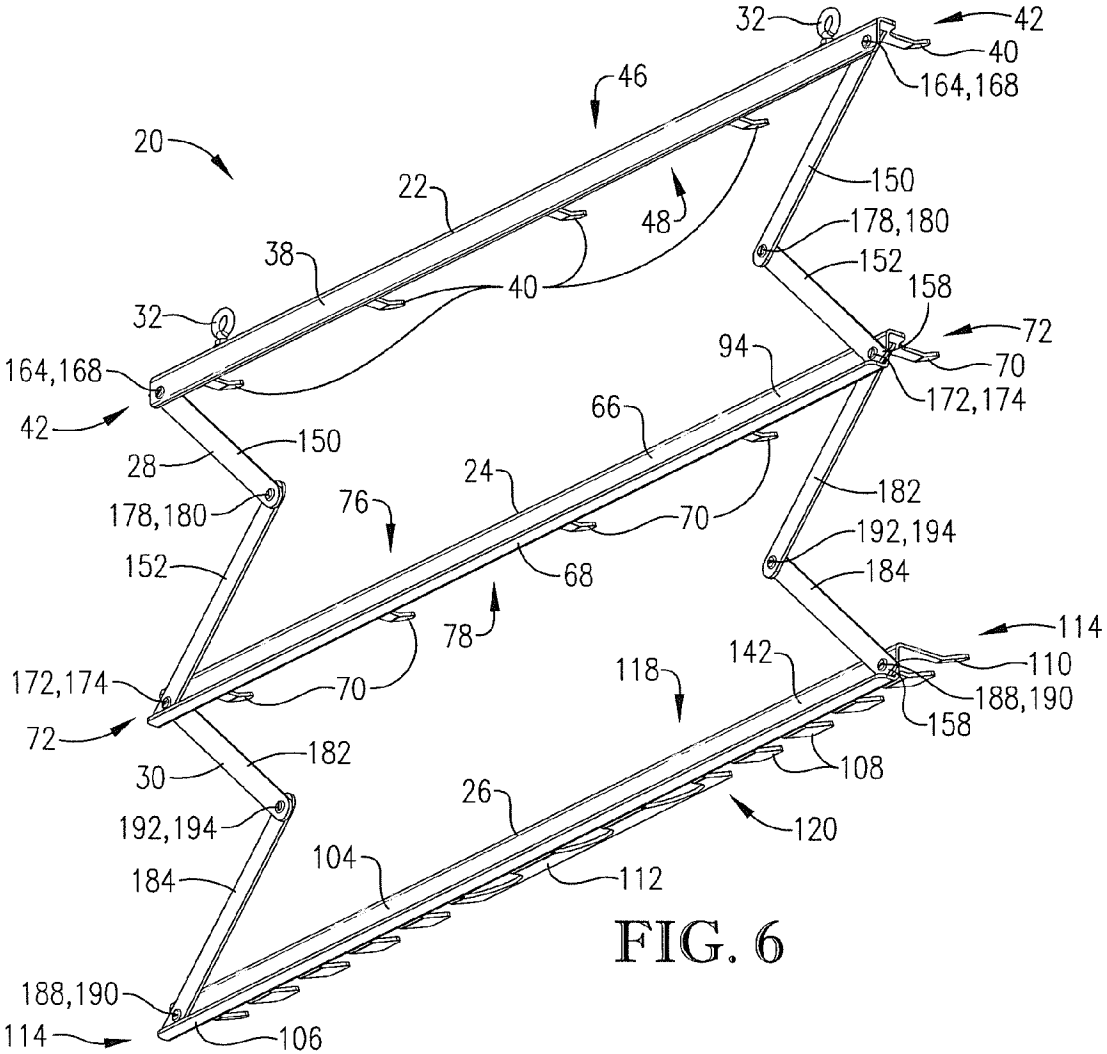
Figures 7, 8:
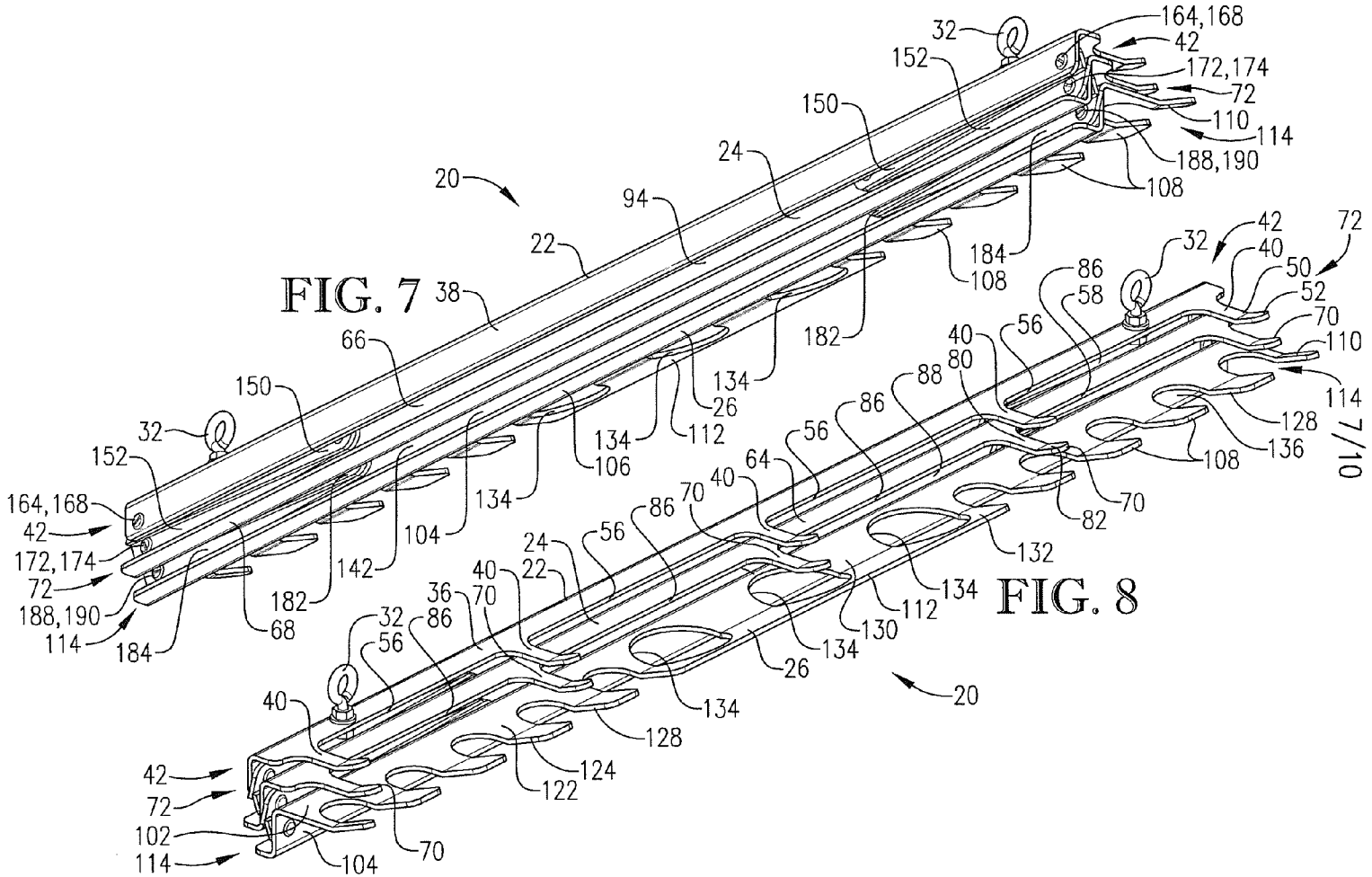
Figure 9:
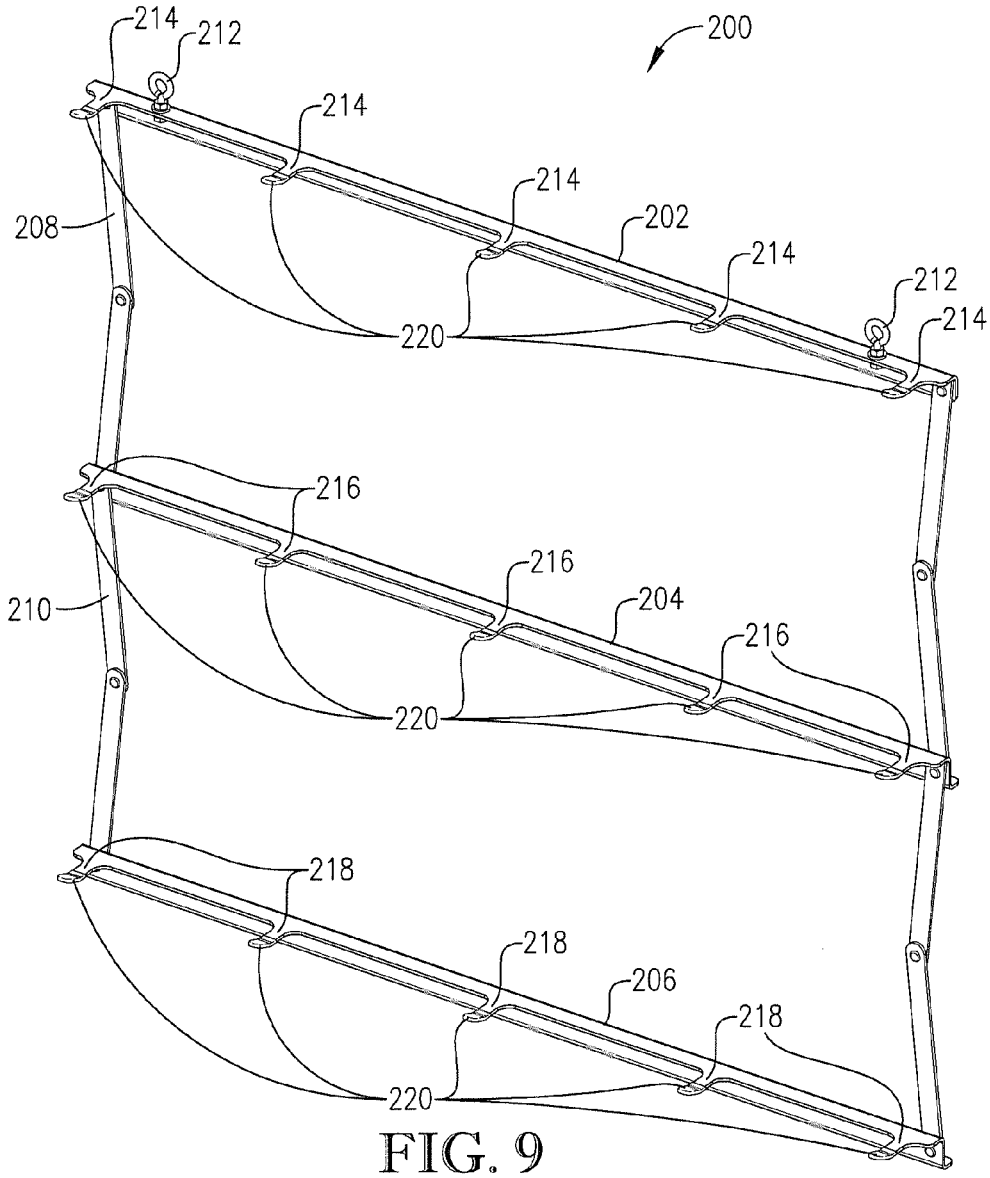
Figure 10:
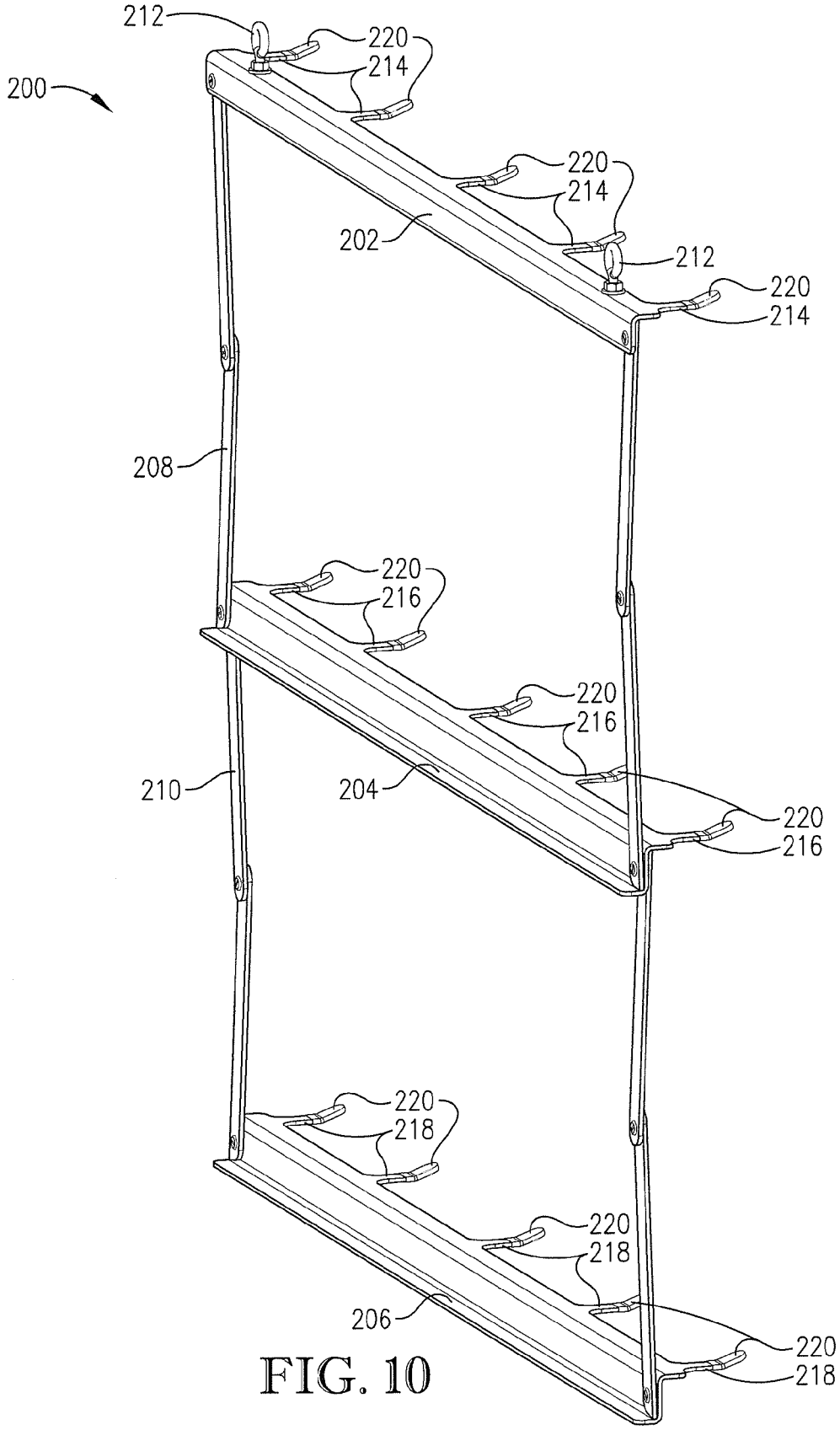
Figure 11:
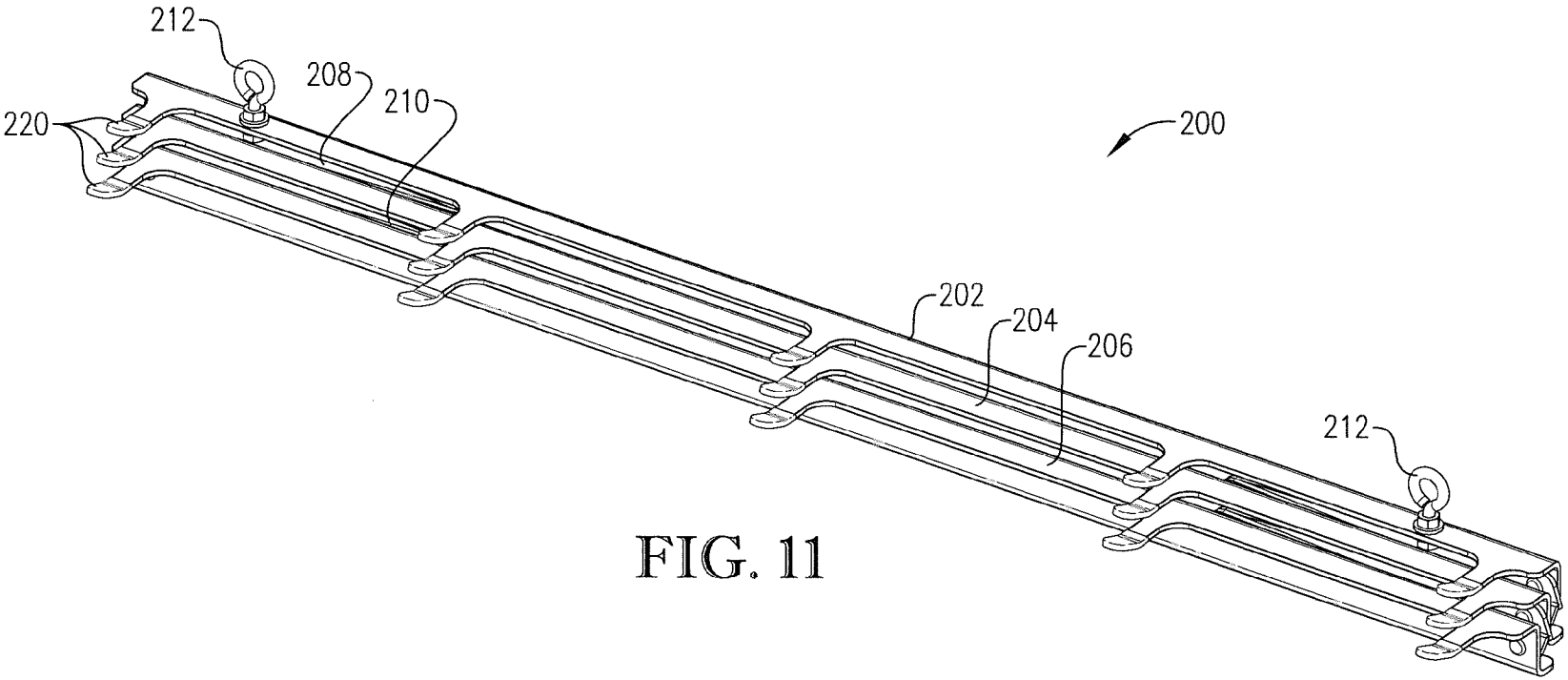

FIG. 4*a* is a fragmentary side elevation of the collapsible rack shown in FIGS. 1-3, with the collapsible rack cross-sectioned and shown in the extended condition, and showing the rack members and foldable arms interconnected by fasteners;

FIG. 4*b* is a side elevation of the collapsible rack shown in FIGS. 1-3 and 4*a*, with the collapsible rack cross-sectioned and shown in a collapsed condition, and showing enclosed slots cooperatively formed by adjacent rack members in the collapsed condition, with the foldable arms located in folded positions and each received in a corresponding slot;

FIG. 5 is a front elevation of the collapsible rack shown in FIGS. 1-3, 4*a*, and 4*b*, showing the collapsible rack in the extended condition, with the foldable arms in the unfolded position, and showing the collapsible rack in phantom lines shifted into a partly collapsed condition between the extended and collapsed condition, with the foldable arms being pivoted into an intermediate position between folded and unfolded positions;

FIG. 6 is a rear perspective of the collapsible rack shown in FIGS. 1-5, showing the collapsible rack in the partly collapsed condition and the foldable arms in the intermediate position;

FIG. 7 is a rear perspective of the collapsible rack shown in FIGS. 1-6, showing the collapsible rack shifted adjacent the collapsed condition, with the rack members spaced apart to show the interconnected foldable arms positioned adjacent to one another;

FIG. 8 is a front perspective of the collapsible rack shown in FIGS. 1-7, showing the collapsible rack shifted adjacent the collapsed condition;

FIG. 9 is a front perspective of a collapsible rack constructed in accordance with a second embodiment of the present invention, with the collapsible rack in an extended condition;

FIG. 10 is a rear perspective of the collapsible rack shown in FIG. 9, with the collapsible rack in the extended condition; and FIG. 11 is a front perspective of the collapsible rack shown in FIGS. 9 and 10, showing the collapsible rack shifted adjacent a collapsed condition.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

Turning initially to FIGS. 1-3, a collapsible rack 20 is operable to store softball equipment, such as bats T, ball B, gloves G, and hats H as shown in the illustrated embodiment. However, it is also within the scope of the present invention, where rack 20 serves to hold other types of sports equipment. Furthermore, the illustrated rack 20 could be used in other storage applications, such as the storage of household items (e.g., hand tools). As will be discussed in greater detail, the rack 20 is preferably portable and is collapsible from an extended condition (see FIG. 1) to a collapsed condition (see FIG. 4*b*). The rack 20 broadly includes upper, intermediate, and lower rack members 22,24,26, upper and lower linkage assemblies 28,30, and eye bolt assemblies 32.

The illustrated rack 20 is removably attached to chain-link fence F (e.g., as part of a softball or baseball dugout construction) with S-hooks 34 to cooperatively provide a removably mountable rack assembly. However, the rack 20 could be attached to an alternative support structure, such as a concrete, drywall, or plywood wall structure, without departing from the scope of the present invention. Furthermore, a connection mechanism other than S-hooks 34, e.g., carabiner clips, threaded fasteners, etc., could be used to removably mount the rack 20 to a structure. While the illustrated rack 20 is preferably attached by fasteners to the fence F along an uppermost rack member, it is also within the scope of the present invention where other portions of the rack 20 are secured to the fence F with fasteners, either additionally or alternatively to uppermost rack member.

Turning to FIGS. 2-8, rack members 22,24,26 are each preferably configured with hook-type projections for holding items as illustrated in FIG. 1. However, it is also within the ambit of the present invention where at least one of the rack members 22,24,26 do not hold or store items or other equipment (i.e., where the rack member is devoid of any hooks or forwardly extending projections). Preferably, the upper rack member 22 is unitary and includes a body with upper and central flanges 36,38 and five (5) hooks 40 attached to the body, although the member 22 could include an alternative number of hooks 40. The flanges 36,38 preferably extend in a lateral direction between ends 42 of the rack member 22 along a lateral body axis, with the rack member 22 having a substantially constant cross section along the lateral direction. Preferably, the central flange 38 has an upright orientation and presents upper and lower margins 46,48 (see FIGS. 4*a* and 4*b*), while the upper flange 36 preferably has a lateral orientation substantially transverse to the central flange 38. Thus, the illustrated rack member 22 preferably has an L-shaped cross section, with the upper flange 36 being attached to the upper margin 46 of the central flange 38. The hooks 40 are spaced laterally along the length of the body and project in a forward direction from the upper flange 36. The hooks 40 each preferably include a proximal section 50 and an upturned distal section 52, with the proximal section 50 being attached to a distal margin 54 of the upper flange 36.

The upper flange 36 and adjacent pairs of hooks 40 cooperatively present slots 56 spaced laterally along the member 22. Flanges 36,38 and hooks 40 also cooperatively present a front channel 58 with an open face 60 (see FIG. 4*a*). The open face 60 preferably extends between the lower margin 48 of flange 38 and a forwardmost edge 62 presented by hooks 40 (see FIG. 4*a*). As will be discussed, the front channel 58 is configured to receive the rack member 24 in a nested arrangement when the rack 20 is in the collapsed condition.

Preferably, the intermediate rack member 24 is unitary and includes a body with upper, central, and lower flanges 64,66,68 and five (5) hooks 70 attached to the body, although the member 24 could include an alternative number of hooks 70. The flanges 64,66,68 preferably extend continuously in a lateral direction between ends 72 of the rack member 24 along a lateral body axis, with the rack member 24 having a substantially constant cross section along the lateral direction. Preferably, the central flange 66 has an upright orientation and presents upper and lower margins 76,78 (see FIGS. 4*a* and 4*b*), while flanges 64,68 have a lateral orientation substantially transverse to the central flange 66. The illustrated flanges 64,66,68 preferably present an S-shaped cross section, with the upper and lower flanges 64,68 being attached to corresponding upper and lower margins 76,78 of central flange 66. The hooks 70 are spaced laterally along the length of the body and project in a forward direction from the upper flange 64. Hooks 70 include proximal section 80 and upturned distal section 82, with the proximal section 70 being attached to a distal margin 84 of the upper flange 64.

The upper flange 64 and adjacent pairs of hooks 70 preferably cooperatively present slots 86. The flanges 64,66,68 and hooks 70 preferably cooperatively present a front channel 88 with an open face 90 (see FIG. 4*a*). The open face 90 preferably extends between the lower margin 78 and a forwardmost edge 92 of the hooks 70 (see FIG. 4*a*). Similarly, flanges 64,66,68 preferably cooperatively present a rear channel 94 with an open face 96 that extends between the upper margin 76 and a rearwardmost edge 98 of the lower flange 68 (see FIG. 4*a*).

The illustrated rack members 22,24 preferably present cross-sectional shapes that permit stacking of the rack members 22,24 in a nested arrangement when the rack 20 is in the collapsed condition. While rack member 22 presents an L-shaped cross section and rack member 24 presents an S-shaped cross section, the rack members 22,24 could have alternative shapes that permit nestable stacking.

Members 22,24 are preferably nested in the collapsed condition such that the intermediate rack member 24 is received in front channel 58 of upper rack member 22 when the members 22,24 are in the collapsed condition. The illustrated members 22,24 include similar upper and central flanges, but are not interchangeably positionable in rack 20 because the upper rack member 22 is devoid of a lower flange similar to lower flange 68. However, the principles of the present invention are applicable where rack member 22 includes a lower flange such that the members 22,24 can be interchangeably assembled as part of rack 20. Members 22,24 could be nestably arranged so that the upper rack member 22 is received in the front channel 88 of intermediate rack member 24. In the collapsed condition, corresponding hooks 50,80 of members 22,24 are preferably closely spaced so as to be stacked on top of one another and in contacting engagement. However, the hooks 50,80 could present an alternative lateral spacing.

In the collapsed condition, the flanges of members 22,24 preferably form a laterally extending enclosed slot 100 (see FIG. 4*b*). In particular, the central flanges 38,66 cooperatively define the slot 100. The slot 100 presents a top and bottom that are preferably substantially covered by corresponding upper and lower flanges 36,68. As will be discussed further, the slot 100 serves to receive corresponding upper linkage assembly 28.

The lower rack member 26 is preferably unitary and includes a body with upper, central, and lower flanges 102, 104,106, hooks 108, end hooks 110, and center flange extension 112. The flanges 102,104,106 preferably extend continuously in a lateral direction between ends 114 along a lateral body axis, with flanges 104,106 having a substantially constant cross section along the lateral direction. Preferably, the central flange 104 has an upright orientation and presents upper and lower margins 118,120 (see FIGS. 4*a* and 4*b*), while flanges 102,106 have a lateral orientation substantially transverse to the central flange 104. Thus, the illustrated flanges 102,104,106 preferably present an S-shaped cross section, with the upper and lower flanges 102,106 being attached to corresponding upper and lower margins 118, 120 of the central flange 104.

The hooks 108,110 include proximal section 122 and upturned distal section 124, with the proximal section 122 being attached to a distal margin 126 of the upper flange 102. The upper flange 102, hooks 108,110, and center flange extension 112 cooperatively present slots 128 spaced along the lateral direction.

The center flange extension 112 includes proximal section 130 and upturned distal section 132. The proximal section 130 is attached to the distal margin 126 of the upper flange 102. The flange extension 112 also presents laterally spaced openings 134. The flanges 102,104,106, hooks 108,110, and flange extension 112 cooperatively present a front channel 136 with an open face 138 (see FIG. 4*a*). The open face 138 preferably extends between the lower margin 120 and a forwardmost edge 140 presented by the hooks 108,110 and flange extension 112 (see FIG. 4*a*). Similarly, the flanges 104,106 cooperatively present a rear channel 142 that presents an open face 144, with the open face 144 extending between the upper margin 118 and a rearwardmost edge 146 of the lower flange 106 (see FIG. 4*a*).

The rack members 24,26 preferably present cross-sectional shapes that permit stacking of the members 24,26 in a nested arrangement when the rack 20 is in the collapsed condition. While the illustrated rack members 24,26 present similar S-shaped cross sections, the rack members 24,26 could have alternative shapes that permit nestable stacking.

The illustrated members 24,26 are preferably nested such that lower rack member 26 is received within the front channel 88 of the intermediate rack member 24. However, the rack members 24,26 could be alternatively nested without departing from the scope of the present invention. For instance, the rack members 24,26 could be nestably arranged so that the intermediate member 24 is received by the front channel 136 of lower member 26. Furthermore, it is within the ambit of the present invention where upper and lower rack members 22,26 could be arranged within the rack 20 to be nested with each other. In other words, the illustrated rack members 24,26 are substantially interchangeable and can be selectively interchanged within the rack 20.

In the collapsed condition, the flanges of illustrated rack members 24,26 preferably form a laterally extending enclosed slot 148 (see FIG. 4*b*). In particular, the central flanges 66,104 cooperatively define the slot 148. The slot 148 presents a top and bottom that are preferably substantially covered by corresponding upper and lower flanges 64,106. As will be discussed further, the slot 148 serves to receive corresponding lower linkage assembly 30. While the illustrated rack 20 preferably includes three rack members 22,24,26, it is also within the scope of the present invention where the rack 20 includes an alternative number of rack members, e.g., two rack members or more than three rack members.

The illustrated rack members 22,24,26 preferably present substantially the same fixed lateral length. However, it is also within the scope of the present invention where the members have different lengths or have an adjustable length. Furthermore, the rack members 22,24,26 are preferably substantially linear in the lateral direction but could also present a non-linear shape in the lateral direction (e.g., where the rack members extend along a curved or angled body axis).

Preferably, the rack members 22,24,26 are made from an aluminum material, but could be made from other materials, such as steel, wood, or plastic, without departing from the scope of the present invention. In addition, the rack members 22,24,26 preferably include a powder coating applied to the aluminum material, although other coatings, such as enamel paint, could be applied to provide a finish that is attractive and resistant to scratches, wear, and corrosion.

While the illustrated rack members 22,24,26 preferably include fixed hooks 40,70,108,110, the rack members 22,24, 26 could have other shaped projections without departing from the scope of the present invention. For example, the illustrated hooks could project in other directions, e.g., where rack members include one or more hooks that project laterally or rearwardly from the body of the rack member. Also, the illustrated rack members could have one or more shiftable equipment storage elements, e.g, a spring-loaded clamp, mounted to the body and selectively shiftable to grab and release stored objects. It is also within the ambit of the present invention where at least one of the rack members 22,24,26 is devoid of hooks or other storage elements that project from the body for storing objects. The illustrated hooks 40,70,108, 110 and flange extension 112 are devoid of a covering along the forwardmost edges thereof, but could include a protective cap or cover (such as the caps of the second embodiment described below) to restrict potential snagging or puncturing of an object by one of the rack members 22,24,26.

Turning again to FIGS. 2-8, upper and lower linkage assemblies 28,30 are operable to interconnect rack members 22,24,26 while allowing shifting of the rack 20 between collapsed and extended conditions. As will be discussed in greater detail, the assemblies 28,30 also allow nestable stacking of the rack members 22,24,26 in the collapsed condition.

The upper linkage assembly 26 preferably includes upper and lower pairs of folding arms 150,152 that are preferably substantially identical to one another. Each of the folding arms 150,152 is elongated and presents opposite arm and rack connection ends 154,156, with the rack connection end 156 including a projection 158. The projection 158 extends primarily to one side of an axis of the corresponding folding arm 150,152. As will be discussed, the illustrated projections 158 each serve as a stop to engage the corresponding rack member and restrict pivotal arm movement. However, it is within the ambit of the present invention where the arms 150,152 include an alternative stop element.

Each of the folding arms 150,152 also presents arm holes 160 adjacent the ends 154,156 for pivotal connection of the arms 150,152 as will be discussed. The arm holes 160 of each arm define a fixed arm radius R1 therebetween (see FIG. 5). The illustrated folding arms 150,152 preferably present substantially the same radius R1 so that the folding arms 150,152 cooperatively permit the rack members 22,24 to be nested in the collapsed condition.

Preferably, the folding arms 150,152 are made from an aluminum material, but could be made from other materials, such as steel, wood, or plastic, without departing from the scope of the present invention. In addition, the folding arms 150,152 preferably include a powder coating applied to the aluminum material, although other coatings, such as enamel paint, could be applied to provide a finish that is attractive and resistant to scratches, wear, and corrosion.

The upper folding arms 150 are preferably pivotally attached to upper rack member 22. In particular, the upper rack member 22 presents holes 162 in central flange 38 adjacent to corresponding rack ends 42. Fasteners 164 are inserted through arm holes 160 adjacent to rack connection ends 156 and holes 162 to secure a respective folding arm 150 to the rack member 22, with the folding arm 150, fastener 164, and rack member 22 cooperatively defining an upper rack pivot joint that permits swinging movement about a fore-and-aft axis. The illustrated fasteners 164 preferably include washers 166, threaded binding posts 168 having male and female threaded elements, and a thread-locking liquid applied between the elements. However, it is also within the scope of the present invention where an alternative fastener is used for connecting the arms to the rack member, such as another type of threaded fastener or a rivet.

The lower folding arms 152 are preferably pivotally attached to intermediate rack member 24. In particular, the intermediate rack member 24 presents holes 170 in central flange 66 adjacent to corresponding rack ends 72. Fasteners 172 are inserted through holes 160 adjacent to rack connection ends 156 and holes 172 to secure a respective folding arm 152 to the rack member 24, with the folding arm 152, fastener 172, and rack member 24 partly defining a central rack pivot joint that permits swinging movement about a fore-and-aft axis. As will be discussed, arms of the linkage assembly 30 also form part of the central rack pivot joints. The illustrated fasteners 172 preferably include washers 166, threaded binding posts 174 having male and female threaded elements, and a thread-locking liquid applied between the elements. It is also within the scope of the present invention where an alternative fastener is used for connecting the arms to the rack member, such as another type of threaded fastener or a rivet.

The upper and lower folding arms 150,152 are pivotal between folded and unfolded positions. In the folded position, each arm 150 extends laterally and is positioned in front of central flange 38. Thus, each arm 150 is substantially received in front channel 58 and is preferably substantially positioned between ends of the rack member 22. Similarly, each arm 152 extends laterally and is positioned behind the central flange 66. Thus, each arm 152 is substantially received in the rear channel 94 and is preferably substantially positioned between ends of the rack member 24. Preferably, the axes of the arms 150,152 and the lateral axis of the corresponding rack members 22,24 are substantially aligned, i.e., parallel to one another.

In the unfolded position, the projection 158 of each arm 150,152 preferably engages the corresponding one of the upper and lower flanges 36,68 to restrict arm rotation, with the projection 158 of each arm being located laterally outwardly from the corresponding pivot joint. Thus, the projections 158 preferably restrict movement of the arms 150,152 such that the arms 150,152 only rotate laterally inwardly from the unfolded position. However, for some aspects of the present invention, the arms 150,152 could fold laterally outwardly from the unfolded position into the folded position. Furthermore, it is also within the scope of the present invention where the members 22,24 have an alternative structure to engage and restrict arm rotation.

Preferably, the axes of each arm 150,152 and the corresponding rack members 22,24 present an angle θ1 that is acute (i.e., less than about 90 degrees) in the unfolded position (see FIG. 5). More preferably, the angle θ1 is between about 45 degrees and about 90 degrees. However, for some aspects of the present invention, the angle θ1 could be about 90 degrees or greater than about 90 degrees (e.g., where the arms are configured to fold by rotating in a laterally outwardly direction).

Corresponding pairs of arms 150,152 are preferably pivotally interconnected adjacent arm connection ends 154 by inserting fasteners 178 through corresponding arm holes 160. The fasteners 178 preferably include washers 166, binding posts 180 having male and female threaded elements, and a thread-locking liquid applied between the elements. Thus, corresponding pairs of folding arms 150,152 and fasteners 178 cooperatively define a pivotal arm joint that permits relative swinging movement between the arms about a fore-and-aft axis. Each set of interconnected arms 150,152 and fasteners 178 provide an upper linkage that shiftably interconnects the upper and intermediate rack members 22,24. The upper linkages permit relative shifting of the rack members 22,24 along an upright extension direction that is substantially perpendicular to the lateral direction and to the forward direction. Additionally, the illustrated arms 150,152 are arranged preferably so that the lower folding arms 152 are positioned in front of the upper folding arms 150. Further, the arms 150,152 are attached between the rack members 22,24 along the forward direction to permit nestable stacking of rack members 22,24.

In the unfolded position, the arms 150,152 are upright and spaced vertically between members 22,24, with an included angle α1 being preferably less than 180 degrees to encourage folding of the arms 150,152 (see FIG. 5). However, for some aspects of the present invention, the angle α1 could be greater than about 180 degrees (e.g., where the arms are configured to fold by rotating in a laterally outwardly direction). Specifically, this arrangement has been found to allow automatic collapsing of the rack 20 by gravity without the necessity of forcing the arms 150,152 to fold inwardly. Furthermore, this arrangement has been found to limit pinching between rack components when the rack 20 is collapsed. The illustrated arm joint between arms 150,152 is also preferably spaced laterally inwardly from the respective pivot joints such that the arms 150,152 cooperatively fold inwardly from the unfolded position. However it is also within the scope of the present invention where the arms are arranged to cooperatively fold outwardly from the unfolded position.

In the folded position, the arms 152 are preferably positioned in front of arms 150 and are substantially parallel with each other. Furthermore, the arms 150,152 are substantially entirely received within the corresponding enclosed slot 100 and are positioned between the top and bottom of the slot 100. Thus, the arms are enclosed by respective flanges of the rack members 22,24 to restrict pinching. The illustrated construction of inwardly rotating arms 150,152 preferably permits the arms to be positioned within the slot 100 when the rack is in the collapsed condition, but it is also within the scope of the present invention where the arms 150,152 are pivotally mounted along the rack members 22,24 to be positioned within the slot 100 while rotating outwardly into the collapsed position.

Lower linkage assembly 30 includes upper and lower pairs of folding arms 182,184 that are preferably substantially identical to one another. The illustrated folding arms 182,184 are also substantially identical to arms 150,152, although the arms 182,184 could present a different length compared to arms 150,152 to provide correspondingly different spacing between rack members 24,26. The folding arms 182,184 are elongated and present opposite arm and rack connection ends 154,156, with the rack connection ends 156 preferably including projections 158. The illustrated projections 158 of arms 182,184 each serve as a stop to engage the corresponding rack member and restrict pivotal arm movement. However, it is within the ambit of the present invention where the arms 182,184 include an alternative stop element.

Each of the folding arms 182,184 also presents arm holes 160 adjacent the ends 154,156 for pivotal connection of the arms 182,184 as will be discussed. The arm holes 160 of each arm 182,184 define a fixed arm radius R2 therebetween (see FIG. 5). The illustrated folding arms 182,184 preferably present substantially the same radius R2 in order to permit the rack members 24,26 to be nested in the collapsed condition. Preferably, the radius R2 of arms 182,184 is substantially the same as radius R1 of arms 150,152. However, the principles of the present invention are applicable where R2 is longer or shorter than R1 to provide spacing between rack members 24,26 that is different from the spacing between rack members 22,24 in the extended condition.

The upper folding arms 182 are preferably pivotally attached to rack member 24. In particular, the rack member 24 presents holes 170 in central flange 66 adjacent to corresponding rack ends 72. Fasteners 172 are inserted through arm holes 160 adjacent to rack connection ends 156 and holes 170 to secure a respective folding arm 182 to the rack member 24, with the folding arms 152,182, fastener 172, and rack member 24 cooperatively defining the central rack pivot joint. However, it is also within the scope of the present invention where folding arms 152,182 are pivotally attached to rack member 24 at different pivot joints.

The lower folding arms 184 are preferably pivotally attached to lower rack member 26. In particular, the lower rack member 26 presents holes 186 in central flange 104 adjacent to corresponding rack ends 114. Fasteners 188 are inserted through arm holes 160 adjacent to rack connection ends 156 and holes 186 to secure a respective folding arm 184 to the rack member 26, with the folding arm 184, fastener 188, and rack member 26 cooperatively defining a lower rack pivot joint that permits swinging movement about a fore-and-aft axis. The illustrated fasteners 188 preferably include washers 166, threaded binding posts 190 having male and female threaded elements, and a thread-locking liquid applied between the elements. It is also within the scope of the present invention where alternative fasteners are used for connecting the arms 182,184 to the corresponding rack members 24,26, such as another type of threaded fastener or a rivet.

The upper and lower folding arms 182,184 are preferably pivotal between folded and unfolded positions. In the folded position, each arm 182 extends laterally and is positioned in front of central flange 66. Thus, each arm 182 is substantially received in front channel 88 and is preferably substantially positioned between ends of the rack member 24. Similarly, each arm 184 extends laterally and is positioned behind the central flange 104. Thus, each arm 184 is preferably substantially received in the rear channel 142 and is preferably substantially positioned between ends of the rack member 26. Preferably, the axes of the arms 182,184 and the lateral axis of the corresponding rack members 24,26 are substantially aligned, i.e., parallel to one another.

In the unfolded position, the projection 158 of each arm 182,184 engages the corresponding one of the upper and lower flanges 64,106 to restrict arm rotation, with the projection 158 of each arm being located laterally outwardly from the corresponding pivot joint. Thus, the projections 158 preferably restrict movement of the arms 182,184 such that the arms 182,184 only rotate laterally inwardly from the unfolded position. However, for some aspects of the present invention, the arms 182,184 could fold laterally outwardly from the unfolded position into the folded position. Furthermore, it is also within the scope of the present invention where the members 24,26 have an alternative structure to engage and restrict arm rotation.

Preferably, the axes of each arm 182,184 and the corresponding rack members 24,26 present an angle $\theta 2$ that is acute (i.e., less than about 90 degrees) in the unfolded position (see FIG. 5). More preferably, the angle $\theta 2$ is between about 45 degrees and about 90 degrees. However, for some aspects of the present invention, the angle $\theta 2$ could be about 90 degrees or greater than about 90 degrees (e.g., where the arms are configured to fold by rotating in a laterally outwardly direction).

Corresponding pairs of arms 182,184 are preferably pivotally interconnected adjacent arm connection ends 154 by inserting fasteners 192 through corresponding arm holes 160. The fasteners 192 preferably include washers 166, binding posts 194 having male and female threaded elements, and a thread-locking liquid applied between the elements. Thus, corresponding pairs of folding arms 182,184 and fasteners 192 cooperatively define a pivotal arm joint that permits relative swinging movement between the arms about a fore-and-aft axis. Each set of interconnected arms 182,184 and fasteners 192 cooperatively provide a lower linkage that shiftably interconnects the upper and intermediate rack members 24,26 and permits relative shifting of the rack members 24,26 along the upright extension direction. Additionally, the illustrated arms 182,184 are arranged preferably so that the lower folding arms 184 are positioned in front of the upper folding arms 182. Further, the arms 182,184 are attached between the rack members 24,26 along the forward direction to permit nestable stacking of rack members 24,26.

In the unfolded position, the arms 182,184 are upright and spaced vertically between members 24,26, with an included angle $\alpha 2$ being preferably less than about 180 degrees to encourage folding of the arms 182,184 (see FIG. 5). However, for some aspects of the present invention, the angle $\alpha 2$ could be greater than about 180 degrees (e.g., where the arms are configured to fold by rotating in a laterally outwardly direction). Again, this arrangement has been found to allow automatic collapsing of the rack 20 by gravity without the necessity of forcing the arms 182,184 to fold inwardly. Furthermore, this arrangement has been found to limit pinching between rack components when the rack 20 is collapsed. The illustrated arm joint between arms 182,184 is also preferably spaced laterally inwardly from the respective pivot joints such that the arms 182,184 cooperatively fold inwardly from the unfolded position. However it is also within the scope of the present invention where the arms are arranged to cooperatively fold outwardly from the unfolded position.

In the folded position, the arms 184 are positioned in front of arms 182 and are substantially parallel with each other. Furthermore, the arms 182,184 are substantially entirely received within the corresponding slot 148 and are position between the top and bottom of the slot 148. Thus, the arms are covered by respective flanges of the rack members 24,26 to restrict pinching. The illustrated construction of inwardly rotating arms 182,184 preferably permits the arms to be positioned within the slot 148 when the rack is in the collapsed condition, but it is also within the scope of the present invention where the arms 182,184 are pivotally mounted along the rack members 24,26 to be positioned within the slot 148 while rotating outwardly into the collapsed position.

The illustrated rack 20 is preferably constructed so that the rack members 22,24,26 are freely shiftable between the collapsed and extended conditions. However, for some aspects of the present invention, the rack 20 could include a latch mechanism that serves to releasably lock the rack members 22,24,26 into the collapsed condition, e.g., where a swingable latch releasably interconnects rack members 22,26, or the extended condition such that the rack 20 can be selectively locked by a user into a corresponding condition.

While the linkage assemblies 28,30 preferably have the illustrated arm arrangement, the linkage assemblies 28,30 could have an alternative arrangement to permit automatic collapsing of rack members by gravity from the extended condition to the collapsed condition. For instance, the linkage assemblies 28,30 could have only one pair of arms pivotally attached to one rack member and slidably attached to lateral slots in the other rack member such that the pair of arms are operable to shift between folded and unfolded positions.

Preferably, the illustrated linkage assemblies 28,30 are configured to permit relative movement between rack members 22,24 that is independent of relative movement between rack members 24,26. In this manner, shifting movement of one of the assemblies 28,30 does not cause the other assembly to shift.

The illustrated linkage assemblies 28,30 also preferably permit translational movement of rack members relative to each other in a direction perpendicular to axes of the rack members. Thus, the intermediate and lower rack members 24,26 simply drop down from the upper rack member 22 when shifted to the extended condition. Similarly, the upper and intermediate rack members 22,24 drop towards the lower rack member 26 when the rack 20 is shifted to the collapsed condition. In this manner, the illustrated assemblies 28,30 allow the rack 20 to maintain substantially the same maximum lateral dimension as the rack 20 is shifted between the conditions. Furthermore, the assemblies 28,30 permit uniform relative shifting between rack members 22,24,26.

In operation, a user can install the collapsed rack 20 by shifting the rack from the collapsed condition to the extended condition. Specifically, the rack 20 can be shifted by lifting upwardly on the upper rack member 22 while the rack 20 is resting on a surface (not shown). As the rack member 22 is lifted, rack members 24,26 are urged by gravity away from rack member 22 so that the arms of the linkage assemblies 28,30 pivot into the unfolded positions. Alternatively, the user can shift the rack 20 into the extended condition by grabbing the upper and lower rack members 22,26 and shifting the members 22,26 in away from each other so that all of the arms pivot into the unfolded positions. Yet further, the rack 20 can be shifted into the extended condition by attaching the rack member 22 to a structure, such as fence F, and then permitting the rack members 24,26 to fall from the rack member 22 under the force of gravity. In the event the rack 20 includes a latch mechanism (as discussed above) to releasably lock the rack members 22,24,26 to each other in the collapsed condition, the latch mechanism would be released prior to shifting the rack 20 into the extended condition.

The rack 20 is also installed by attaching the rack 20 to a corresponding structure, such as fence F. In the illustrated embodiment, S-hooks 34 are attached to respective eye bolts 32 and are removably attached to respective portions of the fence F. The eye bolts 32 and S-hooks 34 are preferably made of steel, but could include other materials, such as other metals, plastic, or wood, suitable for supporting the rack 20.

Similarly, the rack 20 can be uninstalled for transportation by detaching the rack 20 from the support structure, i.e., by removing S-hooks 34 from the fence F. Furthermore, the rack 20 is also shifted from the extended condition to the collapsed condition. Specifically, the rack 20 can be shifted by supporting either of the rack members 22,26 on a surface that restricts downward movement, with the other rack members spaced above the surface. The other rack members are then released so as to be urged by gravity toward the surface, with the arms pivoting into the folded positions. Alternatively, the user can shift the rack 20 into the collapsed condition by grabbing the upper and lower rack members 22,26 and shifting the members 22,26 in toward each other so that all of the arms pivot into the folded positions. In the event the rack 20 includes a latch mechanism (as discussed above) to releasably lock the rack members 22,24,26 to each other in the collapsed condition, the latch mechanism would be secured after the rack 20 is shifted into the collapsed condition.

Turning to FIGS. 9-11, an alternative rack 200 is constructed in accordance with a second embodiment of the present invention. For the sake of brevity, the remaining description will focus primarily on the differences of this alternative embodiment from the rack 20 described above.

The rack 200 includes upper and intermediate rack members 202,204 and alternative lower rack member 206. The rack 200 also includes upper and lower linkage assemblies 208,210, and eye bolt assemblies 212. The rack member 202 is substantially identical to rack member 22 and includes upper and central flanges and hooks 214. Rack members 204,206 are substantially identical to rack member 24 and each include upper, central, and lower flanges and corresponding hooks 216,218. The rack 200 further includes a plurality of protective caps 220 each attached to and covering distal ends of respective hooks 214,216,218. The caps 220 preferably include a pliable synthetic resin material formed to cover the distal end. In this manner, the caps 220 restrict the distal end of hooks 214,216,218 from scratching or puncturing another object.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A collapsible storage rack comprising:

first and second rack members, with the first rack member including a body that presents opposite ends and extends along a lateral direction between the ends, at least one of said rack members including a storage element that projects in a forward direction perpendicular to the lateral direction and is operable to support a stored item in front of the rack, said rack members shiftable along an upright extension direction perpendicular to the forward and lateral directions, said rack members shiftable relative to each other into and out of a collapsed condition; and a linkage assembly shiftably interconnecting the rack members and permitting shifting movement of the rack members into and out of the collapsed condition, said linkage assembly including oppositely spaced first and second foldable arms each pivotally attached to the first rack member about a fore-and-aft axis adjacent to corresponding ends and pivotal into and out of a folded position corresponding with the collapsed condition, said foldable arms being attached between the rack members along the forward direction, with the arms folding in front of the first rack member and folding behind the second rack member in the folded position, said rack members shiftable relative to each other between an extended condition and the collapsed condition, with the rack members being shifted away from each other when shifted from the collapsed condition to the extended condition, said body presenting a lateral axis and the foldable arms projecting along an upright path from the body in an unfolded position corresponding to the extended condition, each of said foldable aims presenting an arm axis, with the arm axes being substantially aligned with the lateral axis in the folded position, each of said arm axes and the lateral axis cooperatively presenting an acute angle in the extended condition, with collapsing movement of the rack members toward each other causing the arms to return to the folded position, said body including a laterally extending central flange, with the foldable arms being pivotally attached to the central flange, said body including a laterally extending transverse flange attached to the central flange, with the transverse flange projecting forwardly of the central flange, said foldable arms engaging the transverse flange in the extended condition.

2. The collapsible storage rack as claimed in claim 1, said foldable arms pivoting toward one another when shifted from the unfolded position to the folded position, with the foldable arms being spaced substantially entirely between the ends of the body.

3. The collapsible storage rack as claimed in claim 1, said linkage assembly including third and fourth foldable arms, with the foldable anus cooperatively providing oppositely spaced linkages that shiftably interconnect the rack members, each linkage including one of the first and second foldable arms and one of third and fourth foldable arms, with the third and fourth foldable arms being pivotally connected to the corresponding first and second foldable arms and the second rack member.

4. The collapsible storage rack as claimed in claim 3, said second rack member including a second body that presents opposite ends and extends along the lateral direction between the ends, said third and fourth foldable arms each pivotally attached to the second rack member about a fore-and-aft axis adjacent to corresponding ends and pivotal into and out of the folded position corresponding with the collapsed condition, said third and fourth foldable arms being attached between the rack members along the fore-and-aft direction, with the third and fourth foldable folding in front of the first rack member and folding behind the second rack member in the folded position.

5. The collapsible storage rack as claimed in claim 1, said foldable arms each presenting a stop that engages the first rack member and restricts pivotal movement of the corresponding arm relative to the first rack member in the extended condition.

6. A collapsible storage rack comprising:

first and second rack members that respectively include first and second bodies, with each body presenting opposite ends and extending along a lateral direction between the ends, at least one of said rack members including a storage element that projects in a forward direction perpendicular to the lateral direction and is operable to support a stored item in front of the rack, said rack members shiftable along an upright extension direction perpendicular to the forward and lateral directions, said rack members shiftable relative to each other into and out of a collapsed condition; and a linkage assembly shiftably interconnecting the rack members and permitting shifting movement of the rack members into and out of the collapsed condition, said linkage assembly including oppositely spaced first and second foldable arms each pivotally attached to the first rack member about a fore-and-aft axis adjacent to corresponding ends and pivotal into and out of a folded position corresponding with the collapsed condition, said foldable arms being attached between the rack members along the forward direction, with the arms folding in front of the first rack member and folding behind the second rack member in the folded position, said linkage assembly including third and fourth foldable arms, with the foldable arms cooperatively providing oppositely spaced linkages that shiftably interconnect the rack members, each linkage including one of the first and second foldable arms and one of third and fourth foldable arms, with the third and fourth foldable arms being pivotally connected to the corresponding first and second foldable arms and the second rack member, said third and fourth foldable arms each pivotally attached to the second rack member about a fore-and-aft axis adjacent to corresponding ends and pivotal into and out of the folded position corresponding with the collapsed condition, said third and fourth foldable aims being attached between the rack members along the fore-and-aft direction, with the third and fourth foldable arms folding in front of the first rack member and folding behind the second rack member in the folded position, said rack members shiftable relative to each other between an extended condition and the collapsed condition, with the rack members being shifted away from each other when shifted from the collapsed condition to the extended condition, said bodies each presenting a lateral axis and the corresponding foldable arms projecting toward one another from the respective bodies in unfolded positions corresponding to the extended condition, each of said foldable arms presenting an arm axis, with the arm axes being substantially aligned with the lateral axis of the respective body in the folded positions, each of said arm axes and the corresponding lateral axis cooperatively presenting an acute angle in the extended condition, with collapsing movement of the rack members toward each other causing the arms to return to the folded position, said bodies including respective first and second central flanges, with the foldable arms being pivotally attached to the corresponding central flange, said bodies including respective first and second transverse flanges attached to the corresponding central flange, with the first transverse flange projecting forwardly of the first central flange and the second transverse flange projecting rearwardly of the second central flange, said foldable arms engaging the corresponding transverse flange in the extended condition.

7. The collapsible storage rack as claimed in claim 6, said foldable arms pivoting toward one another when shifted from the unfolded position to the folded position, with the first and second foldable arms being spaced substantially entirely between the ends of the first body.

8. The collapsible storage rack as claimed in claim 6, said foldable arms each presenting a stop that engages the respective rack member and restricts pivotal movement of the corresponding arm relative to the respective rack member in the extended condition.

9. A collapsible storage rack comprising:

first and second nestable rack members that include respective first and second bodies that each present opposite ends and extend along a lateral direction between the ends, said bodies each including a laterally extending central flange that presents upper and lower side margins, said rack members each including a storage element attached relative to the central flange and operable to support a stored item in front of the rack, said storage elements each projecting from the respective upper side margins in a forward direction perpendicular to the lateral direction to present a forwardmost margin, said rack members shiftable relative to each other into and out of a nested condition; and a linkage assembly shiftably interconnecting the central flanges and permitting shifting movement of the rack members into and out of the nested condition, said central flanges including corresponding channels that present an open face extending between the lower margin and the forwardmost margin, said second rack member projecting through the open face of the first rack member and at least partly received by the corresponding channel in the nested condition, said linkage assembly including oppositely spaced first and second foldable arms each pivotally attached to the first rack member about a fore-and-aft axis adjacent to corresponding ends and pivotal into and out of a folded position corresponding with the nested condition, said foldable arms being attached between the rack members along the forward direction, said foldable arms folding in front of the first rack member and folding behind the second rack member in the folded position, with the arms being positioned at least partly in the channel of the first rack member, said rack members shiftable relative to each other between an extended condition and the collapsed condition, with the rack members being shifted away from each other when shifted from the collapsed condition to the extended condition, said first body presenting a lateral axis and the foldable arms projecting along an upright path from the first body in an unfolded position corresponding to the extended condition, each of said foldable arms presenting an arm axis, with the arm axes being substantially aligned with the lateral axis in the folded position, each of said arm axes and the lateral axis cooperatively presenting an acute angle in the extended condition, with collapsing movement of the rack members toward each other causing the arms to return to the folded position, said foldable arms being pivotally attached to the central flange of the first body, said first body including a laterally extending first transverse flange attached to the central flange of the first body, said first transverse flange projecting forwardly of the central flange of the first body and interconnecting the central flange of the first body and storage element, said foldable arms engaging the first transverse flange in the extended condition.

10. The collapsible storage rack as claimed in claim 9, said foldable arms pivoting toward one another when shifted from the unfolded position to the folded position, with the foldable arms being spaced substantially entirely between the ends of the body.

11. The collapsible storage rack as claimed in claim 10, said central flanges cooperatively defining a laterally extending slot that presents a top and bottom, said foldable arms being substantially received by the slot between the top and bottom, said first transverse flange substantially covering the top to at least partly enclose the foldable aims within the slot.

12. The collapsible storage rack as claimed in claim 9, said linkage assembly including third and fourth foldable arms, with the foldable arms cooperatively providing oppositely spaced linkages that shiftably interconnect the rack members, each linkage including one of the first and second foldable arms and one of third and fourth foldable arms, with the third and fourth foldable arms being pivotally connected to the corresponding first and second foldable arms and the second rack member.

13. The collapsible storage rack as claimed in claim 12, said third and fourth foldable arms each pivotally attached to the second rack member about a fore-and-aft axis adjacent to corresponding ends and pivotal into and out of the folded position corresponding with the collapsed condition, said third and fourth foldable arms being attached between the rack members along the fore-and-aft direction, said third and fourth foldable arms folding in front of the first rack member and folding behind the second rack member in the folded position, with the third and fourth foldable arms being positioned at least partly in the channel of the first rack member.

14. The collapsible storage rack as claimed in claim 9, said foldable arms each presenting a stop that engages the first rack member and restricts pivotal movement of the corresponding atm relative to the first rack member in the extended condition.

15. The collapsible storage rack as claimed in claim 9, said storage elements contacting each other in the nested condition.

16. A collapsible storage rack comprising:

first and second nestable rack members that include respective first and second bodies that each present opposite ends and extend along a lateral direction between the ends, said bodies each including a laterally extending central flange that presents upper and lower side margins, said rack members each including a storage element attached relative to the central flange and operable to support a stored item in front of the rack, said storage elements each projecting from the respective upper side margins in a forward direction perpendicular to the lateral direction to present a forwardmost margin, said rack members shiftable relative to each other into and out of a nested condition; and a linkage assembly shiftably interconnecting the central flanges and permitting shifting movement of the rack members into and out of the nested condition, said central flanges including corresponding channels that present an open face extending between the lower margin and the forwardmost margin, said second rack member projecting through the open face of the first rack member and at least partly received by the corresponding channel in the nested condition, said linkage assembly including oppositely spaced first and second foldable anus each pivotally attached to the first rack member about a fore-and-aft axis adjacent to corresponding ends and pivotal into and out of a folded position corresponding with the nested condition, said foldable arms being attached between the rack members along the forward direction, said foldable arms folding in front of the first rack member and folding behind the second rack member in the folded position, with the arms being positioned at least partly in the channel of the first rack member, said linkage assembly including third and fourth foldable arms, with the foldable arms cooperatively providing oppositely spaced linkages that shiftably interconnect the rack members, each linkage including one of the first and second foldable arms and one of third and fourth foldable aims, with the third and fourth foldable arms being pivotally connected to the corresponding first and second foldable arms and the second rack member, said third and fourth foldable arms each pivotally attached to the second rack member about a fore-and-aft axis adjacent to corresponding ends and pivotal into and out of the folded position corresponding with the collapsed condition, said third and fourth foldable arms being attached between the rack members along the fore-and-aft direction, said third and fourth foldable arms folding in front of the first rack member and folding behind the second rack member in the folded position, with the third and fourth foldable arms being positioned at least partly in the channel of the first rack member, said rack members shiftable relative to each other between an extended condition and the collapsed condition, with the rack members being shifted away from each other when shifted from the collapsed condition to the extended condition, said bodies each presenting a lateral axis and the corresponding foldable arms projecting toward one another from the respective bodies in unfolded positions corresponding to the extended condition, each of said foldable arms presenting an arm axis, with the arm axes being substantially aligned with the lateral axis of the respective body in the folded positions.

17. The collapsible storage rack as claimed in claim 16, each of said arm axes and the corresponding lateral axis cooperatively presenting an acute angle in the extended condition, with collapsing movement of the rack members toward each other causing the arms to return to the folded position.

18. The collapsible storage rack as claimed in claim 17, said foldable arms being pivotally attached to the corresponding central flange, said bodies including respective first and second transverse flanges attached to the corresponding central flange, with the first transverse flange projecting forwardly of the first central flange and the second transverse flange projecting rearwardly of the second central flange, said foldable arms engaging the corresponding transverse flange in the extended condition.

19. The collapsible storage rack as claimed in claim 18, said foldable arms pivoting toward one another when shifted from the unfolded position to the folded position, with the first and second foldable arms being spaced substantially entirely between the ends of the body.

20. The collapsible storage rack as claimed in claim 18, said central flanges cooperatively defining a laterally extending slot that presents a top and bottom, said foldable arms being substantially received by the slot between the top and bottom, said first transverse flange substantially covering the top and the second transverse flange substantially covering the bottom, with the flanges thereby substantially enclosing the foldable arms within the slot.

21. The collapsible storage rack as claimed in claim 16, said foldable arms each presenting a stop that engages the respective rack member and restricts pivotal movement of the corresponding arm relative to the respective rack member in the extended condition.

22. A collapsible storage rack comprising:

first and second nestable rack members that include respective first and second bodies that each present opposite ends and extend along a lateral direction between the ends, said bodies each including a laterally extending central flange that presents upper and lower side margins, said rack members each including a storage element attached relative to the central flange and operable to support a stored item in front of the rack, said storage elements each projecting from the respective upper side margins in a forward direction perpendicular to the lateral direction to present a forwardmost margin, said rack members shiftable relative to each other into and out of a nested condition; and a linkage assembly shiftably interconnecting the central flanges and permitting shifting movement of the rack members into and out of the nested condition, said central flanges including corresponding channels that present an open face between the lower margin and the forwardmost margin, said second rack member projecting through the open face of the first rack member and at least partly received by the corresponding channel in the nested condition;

a third nestable rack member including a third body that presents opposite ends and extends along the lateral direction between the ends, said third body including a third laterally extending central flange that presents upper and lower side margins, said third rack member including a third storage element attached relative to the third central flange, said third storage element projecting from the upper side margin of the third central flange in the forward direction perpendicular to the lateral direction to present a forwardmost margin of the third rack member, said second and third rack members shiftable relative to each other into and out of the nested condition; and another linkage assembly shiftably interconnecting the central flanges of the second and third rack members and permitting shifting movement into and out of the nested condition, said third central flange including a third channel that presents a respective open face extending between the third lower margin and the third forwardmost margin, said third rack member projecting through the open face of the second rack member and at least partly received by the corresponding channel in the nested condition.

* * * * *